US008337259B2

(12) United States Patent
Chen et al.

(10) Patent No.: US 8,337,259 B2
(45) Date of Patent: Dec. 25, 2012

(54) ELECTRICAL CONNECTOR WITH RELIABLE TERMINAL POSITION

(75) Inventors: To-Ying Chen, New Taipei (TW); Yung-Chang Cheng, New Taipei (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/083,615

(22) Filed: Apr. 11, 2011

(65) Prior Publication Data

US 2012/0122354 A1 May 17, 2012

(30) Foreign Application Priority Data

Nov. 16, 2010 (CN) ..... 2010 2 0610764

(51) Int. Cl.
*H01R 13/42* (2006.01)

(52) U.S. Cl. ..... 439/751

(58) Field of Classification Search ..... 439/744, 439/746, 748, 751
See application file for complete search history.

(56) References Cited

U.S. PATENT DOCUMENTS 5,004,434 A * 4/1991 Aiello et al. ..... 439/636
5,385,491 A * 1/1995 Fry ..... 439/595
5,516,308 A * 5/1996 Yamanashi ..... 439/752
5,609,503 A * 3/1997 Tsuji et al. ..... 439/752
5,664,969 A * 9/1997 Peterson et al. ..... 439/746
5,738,542 A * 4/1998 Jakobeit et al. ..... 439/595
6,244,900 B1 * 6/2001 Ishikawa et al. ..... 439/595
6,302,748 B1 * 10/2001 Xu et al. ..... 439/752.5
6,817,906 B2 * 11/2004 Zhou ..... 439/752.5
6,908,345 B2 * 6/2005 Shimizu et al. ..... 439/682
7,112,105 B2 * 9/2006 Wu ..... 439/752.5
7,118,424 B2 10/2006 Masaki et al.
7,402,087 B2 * 7/2008 Wang ..... 439/752.5
2005/0170702 A1 * 8/2005 Ishikawa ..... 439/751
2005/0266739 A1 * 12/2005 Wu ..... 439/752.5
2011/0256778 A1 * 10/2011 Chen et al. ..... 439/668
2012/0058691 A1 * 3/2012 Ju et al. ..... 439/751

* cited by examiner

*Primary Examiner* — Ross Gushi
(74) *Attorney, Agent, or Firm* — Wei Te Chung; Ming Chieh Chang

(57) ABSTRACT

An electrical connector includes an insulative housing (1) having a top wall (11) and a bottom wall (12) opposite to each other, at least one terminal slot located between the top wall and the bottom wall; a corresponding terminal (2) received in the terminal slot, and the terminal (2) having a body portion (20), a connecting portion (22) extending backwardly from the body portion and a contacting portion (29) extending forwardly from the body portion, the contacting portion (29) defining a positioning slot (28); and wherein there is a positioning member (121) located in the terminal slot and extending into the positioning slot.

18 Claims, 6 Drawing Sheets

ELECTRICAL CONNECTOR WITH RELIABLE TERMINAL POSITION

BACKGROUND OF THE INVENTION

1. Field of the Invention

The present invention relates to an electrical connector, especially to an electrical connector with terminals secured in an insulative housing reliably.

2. Description of Related Art

Digital Still Camera, Cell phone and other portable devices are widely used today. Those devices all have a battery for powering. Thus an electrical connector is used for connecting the battery and corresponding element is required.

For example, U.S. Pat. No. 7,118,424 issued on Oct. 10, 2006 to Masaki et al. introduces an electrical connector for power transmitting. The electrical connector includes an insulative housing, a plurality of terminals mounted to the insulative housing. There are plurality of terminal slots defined in the insulative housing to receive the terminals, respectively. The terminal has a body portion, a connecting portion rearwardly extending from the body portion, and a contacting portion extending forwardly from the body portion and then bent backwardly from a front end thereof. There is a longitudinal slot defined in the mating portion. However, the terminal may sway in the terminal slot, when it is dragged by a cable which is terminated to the connecting portion thereof.

Hence, an improved electrical connector is required to overcome the problems of the prior art.

SUMMARY OF THE INVENTION

An object of the present invention is to provide an electrical connector with terminals being positioned in an insulative housing reliably.

Accordingly, to achieve above-mentioned object, an electrical connector comprises an insulative housing having a top wall and a bottom wall opposite to each other, at least one terminal slot located between the top wall and the bottom wall; a corresponding terminal received in the terminal slot, and the terminal having a body portion, a connecting portion extending backwardly from the body portion and a contacting portion extending forwardly from the body portion, the contacting portion defining a positioning slot; and wherein there is a positioning member located in the terminal slot and extending into the positioning slot.

The detailed features of the present invention will be apparent in the detailed description with appropriate reference to the accompanying drawings.

DETAILED DESCRIPTION OF THE INVENTION

Reference will now be made in detail to the preferred embodiment of the present invention.

Figure 1:
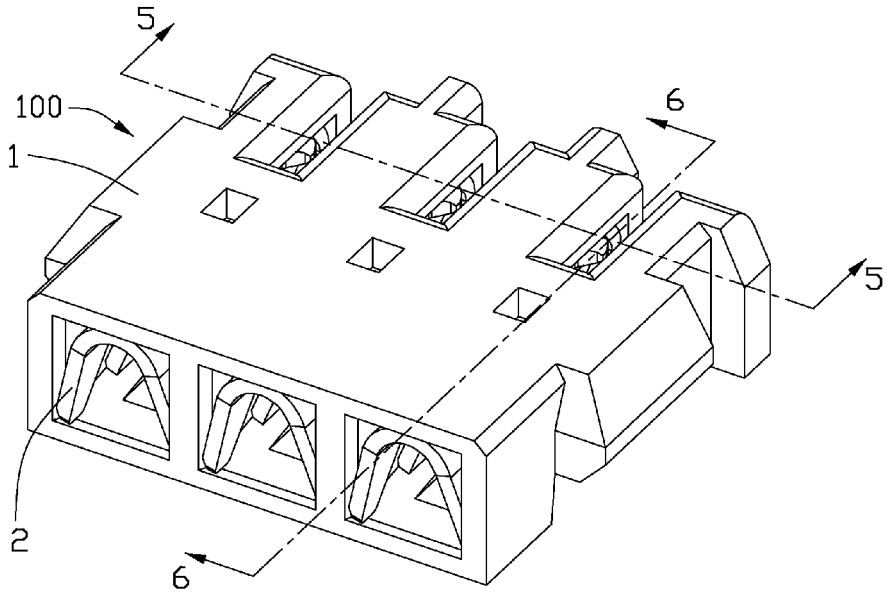
FIG. 1 is an assembled, perspective view of an electrical connector in accordance with the present invention.
Figure 2:
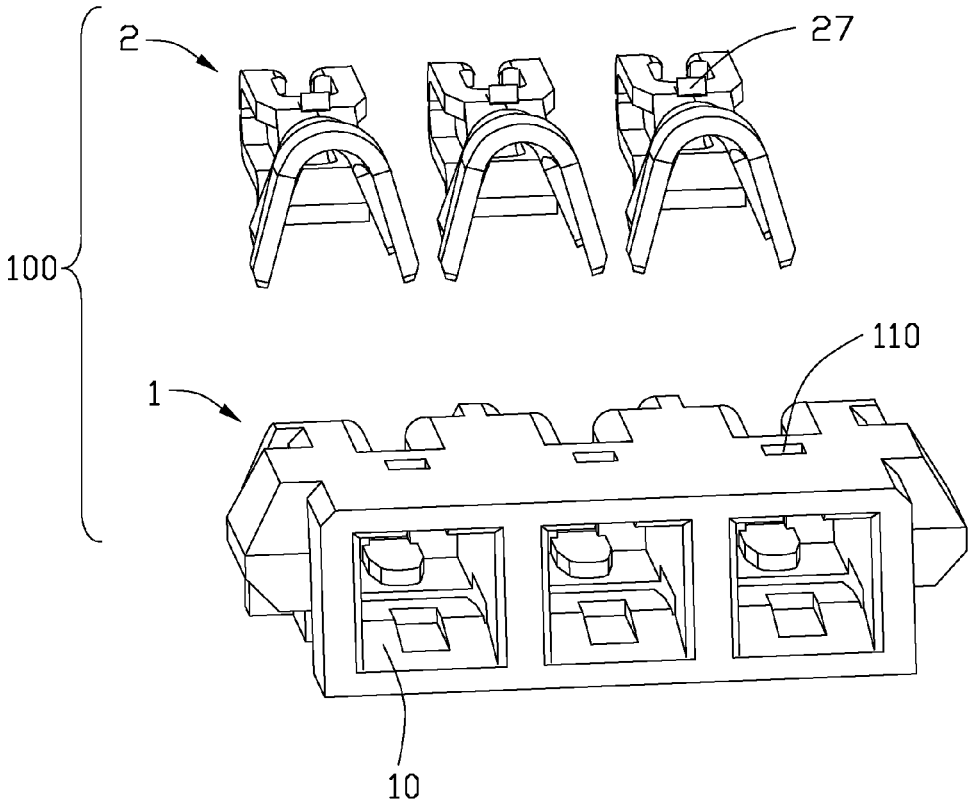
FIG. 2 is an exploded, perspective view of the electrical connector in FIG. 1.
Figure 3:
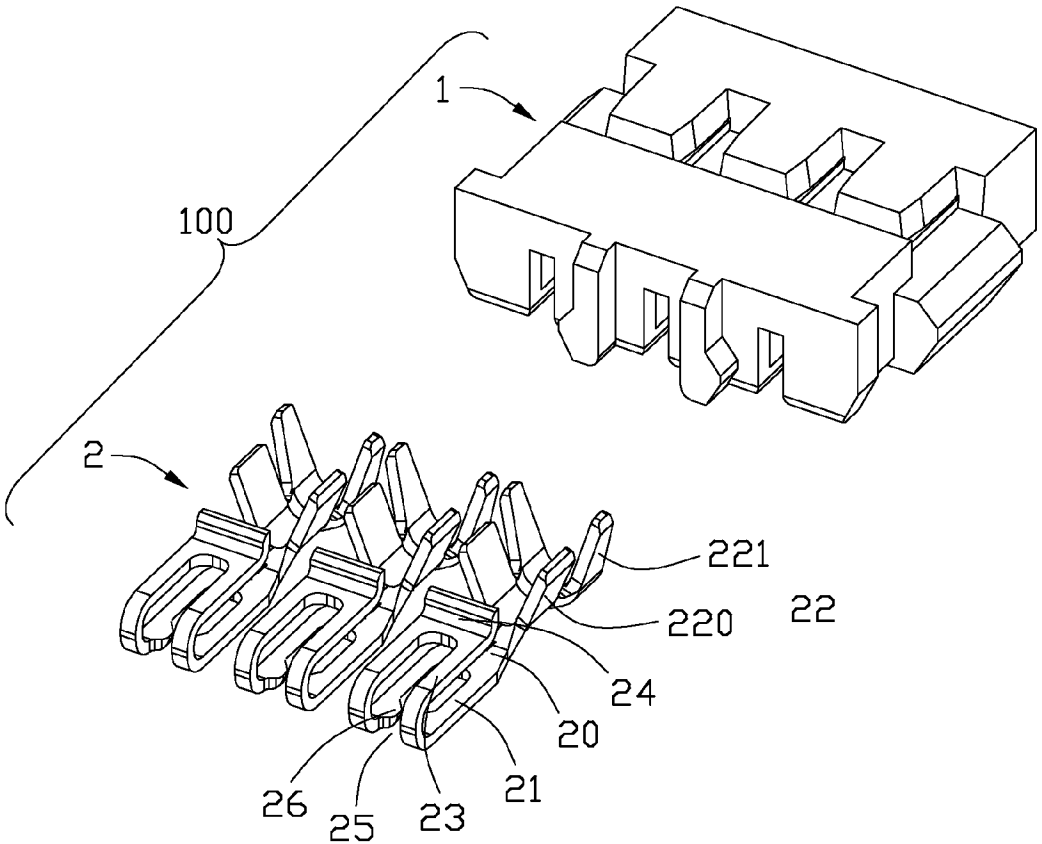
FIG. 3 is similar to FIG. 2, but viewed from other aspect.
Figure 4:
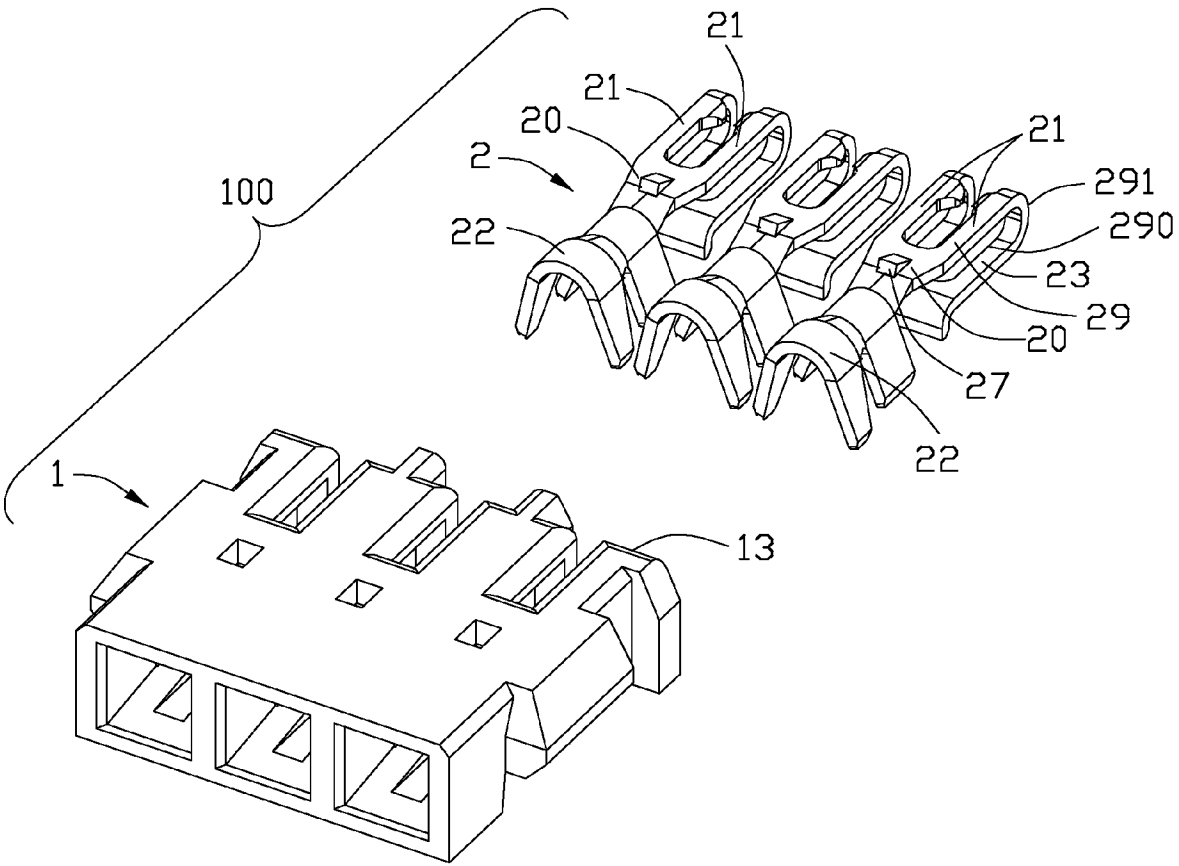
FIG. 4 is similar to FIG. 2, but viewed from other direction.
Figure 5:
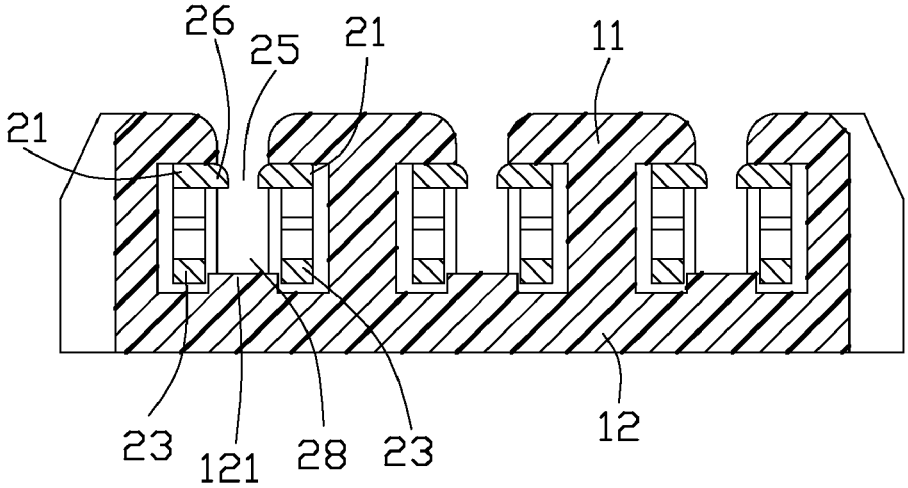
FIG. 5 is a cross-section view of the FIG. 1 taken along a line 5-5.
Figure 6:
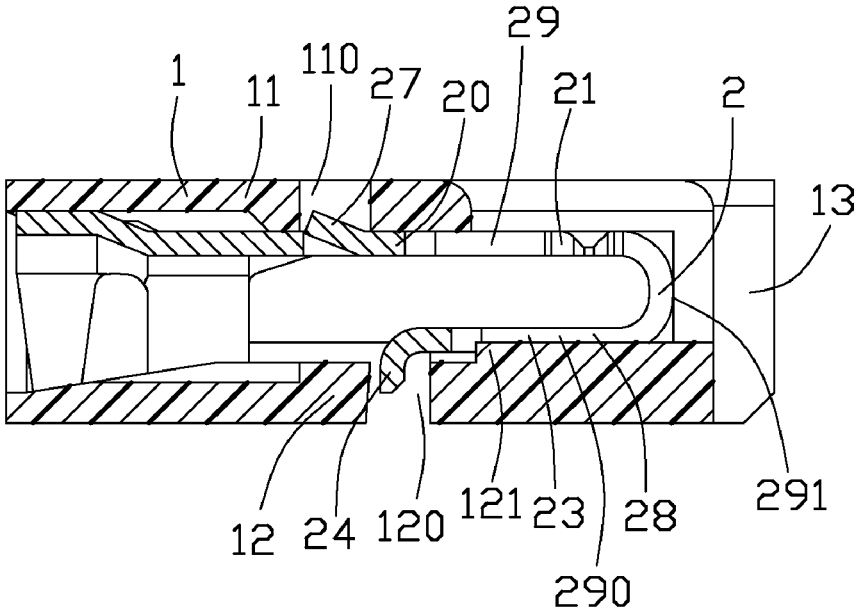
FIG. 6 is a cross-section view of the FIG. 1 taken along a line 6-6.

Referring to FIGS. 1-6, an electrical connector 100 in accordance with the present invention includes an insulative housing 1 and a number of terminals 2 received in the insulative housing 1.

The insulative housing 1 defines a front mating face 13, a top wall 11 and a bottom wall 12 opposite to each other. The insulative housing 1 further defines a number of terminal slots 10 disposed between the top and bottom walls 11, 12, arranged in one row along a transversal direction and through the front mating face 13. The terminals 2 are respectively accommodated in the terminal slots 10.

Each terminal 2 is stamped by a metallic sheet and has a body portion 20, a connecting portion 22 extending backwardly from the body portion 20 and a U-shaped contacting portion 29 extending forwardly from the body portion 20. The contacting portion 29 includes a first extending segment 21 connected to the body portion 20 and located at a first horizontal plane, an intermediate portion 291 extending downwardly from a front end of the first extending segment 21, and a second extending segment 23 located at a second horizontal plane which is under the first horizontal plane. The second extending segment 23 extending backwardly from a lower point of the intermediate portion 291. A longitudinal slot 25 is defined on the first extending segment 21, and two protrusions 26 are formed on the first extending segment 21 and extend into the longitudinal slot 25 from opposite sides thereof. There is hooking portion 24 formed at a back end of the second extending segment 23 and projects downwardly therefrom. The hooking portion 24 is locked into a transversal passage 120 which is located in the bottom wall 12 of the insulative housing 1. Hence, the terminal 2 can not move freely in the terminal slot 10 along the longitudinal direction. In addition, there is a positioning slot 28 defined in the second extending segment 23 and further through the intermediate portion 291. The positioning slot 28 has two lateral edges 291 which are defined on the second extending segment 23 and parallel to each other. There is a tab 27 formed on a top side of the body portion 27. The tab 27 is engaged with a corresponding positioning cavity 110 which is located in the top wall 11. The connecting portion 22 has a first connecting portion 220 connected to the body portion 20 and a second connecting portion 221 connected to the first connecting portion 220 and disposed behind the first connecting portion 220. The first connecting portion 220 is crimped to an inner conductor of a corresponding wire (not shown), and the second connecting portion 221 is crimped to an insulative jacket of the corresponding wire. The is a positioning member 121 formed on inner surface of the bottom wall 12 in each terminal slots 10. As the contacting portion 21 is configured to be U-shaped and resiliently engaged with the terminal slot 10, compressed by the by the top wall 11 and the bottom wall 12, and the positioning member 121 extends into the positioning slot 28 and is against lateral edges 290 of the positioning slot 28 to prevent the terminal 2 moving along the transversal direction.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector, comprising:

an insulative housing having a top wall and a bottom wall opposite to each other, at least one terminal slot located between the top wall and the bottom wall;

a corresponding terminal received in the terminal slot, and the terminal having a body portion, a connecting portion extending backwardly from the body portion and a contacting portion extending forwardly from the body portion, the contacting portion defining a positioning slot; and wherein there is a positioning member located in the terminal slot and extending into the positioning slot;

wherein the contacting portion is of U-shaped;

wherein the contacting portion has a first extending segment and a second extending segment along opposite directions.

2. The electrical connector as claimed in claim 1, wherein the contacting portion is resiliently engaged with the terminal slot.

3. The electrical connector as claimed in claim 1, wherein the first extending segment is located at a first horizontal plane, and the second extending segment is located at a second horizontal plane.

4. The electrical connector as claimed in claim 1, wherein there is a hooking portion projecting downwardly from a back end of the second extending segment and locked into a transversal passage which is located in the bottom wall.

5. The electrical connector as claimed in claim 1, wherein there is an intermediate portion extending downwardly from a front end of the first extending segment, and a second extending segment extends backwardly from a lower point of the intermediate portion.

6. The electrical connector as claimed in claim 5, wherein the positioning slot is defined in the second extending segment and further through the intermediate portion.

7. The electrical connector as claimed in claim 1, wherein there is a longitudinal slot defined on the first extending segment.

8. The electrical connector as claimed in claim 7, wherein there are two protrusions formed on the first extending segment and extend into the longitudinal slot.

9. An electrical connector, comprising:

an insulative housing having a top wall and a bottom wall opposite to each other, with a plurality of terminal slots located therebetween;

a plurality of terminals respectively received in the terminal slot, and each terminal having a body portion and a contacting portion connected with the body portion; and wherein there is a positioning member formed on the bottom wall and extending into a positioning slot located in the contacting portion;

wherein there is a tab formed on the body portion and engaged with a positioning cavity located in the top wall.

10. The electrical connector as claimed in claim 9, wherein the positioning member is against lateral edges of the positioning slot.

11. The electrical connector as claimed in claim 9, wherein the contacting portions of the terminals are compressed by the top wall and the bottom wall.

12. The electrical connector as claimed in claim 9, wherein the contacting portion is U-shaped.

13. The electrical connector as claimed in claim 12, wherein the contacting portion includes a first extending segment projecting forwardly from the body portion and located at a first horizontal plane, an intermediate portion extending downwardly from a front end of the first extending segment, and a second extending segment projecting backwardly from the intermediate portion and located at a second horizontal plane which is under the first horizontal plane.

14. The electrical connector as claimed in claim 13, wherein there is hooking portion formed at a back end of the second extending segment and projects downwardly therefrom, and the hooking portion is locked into a transversal passage defined in the bottom wall.

15. An electrical connector for use with a complementary connector, comprising:

an insulative housing defining opposite front and rear faces in a front-to-back direction, and opposite top and bottom faces in a vertical direction perpendicular to said front-to-back direction;

a plurality of passageways extending through the housing in the front-to-back direction, the top face further equipped with a plurality of slits in alignment with the corresponding passageways in the vertical direction, respectively;

a plurality of contacts disposed in the corresponding passageways, respectively, each of said contacts defining a front mating section for coupling to a terminal of the complementary connector and a rear mounting section for fastening to a wire, said front mating section defining a U-shaped configuration, in a side view, including an upper arm and a lower arm linked with each other via a bight wherein the upper arm essentially intimately confronts a top wall of the housing, the lower arm essentially intimately confronts a bottom wall of the housing, and the bight is located proximate and behind said front face of the housing, an elongated slot extending along and through, in the vertical direction, the U-shaped configuration of the front mating section and essentially aligned with the corresponding slit in the vertical direction; wherein the upper arm defines a pair of protrusions located by opposite sides of the elongated slot and laterally and inwardly extending to each other for efficiently sandwiching the corresponding terminal of the complementary connector while a positioning member upwardly extending from the bottom wall to enter into the elongated slot in the lower arm for retaining the corresponding contact in position.

16. The electrical connector as claimed in claim 15, wherein a distal free end of each of the lower arm forms a closed end to the elongated slot, and said distal free end extends downwardly into a transverse groove in the bottom wall for securing the lower arm in position.

17. The electrical connector as claimed in claim 15, wherein the upper arm is equipped with an upward tab extending into the top wall for retaining the upper arm in position.

18. The electrical connector as claimed in claim 15, wherein the rear mounting section is connected to the upper arm rather than the lower arm.

* * * * *